US010272972B2

(12) United States Patent
Busson

(10) Patent No.: US 10,272,972 B2
(45) Date of Patent: Apr. 30, 2019

(54) FAIRLEAD INTENDED TO ENGAGE WITH AN ANCHOR CHAIN, FOR A SYSTEM FOR ANCHORING A FLOATING INSTALLATION TO THE GROUND

(71) Applicant: NOV-BLM, Carquefou (FR)

(72) Inventor: Philippe Busson, Saint Herblain (FR)

(73) Assignee: NOV-BLM, Carquefou (FR)

( * ) Notice: Subject to any disclaimer, the term of this patent is extended or adjusted under 35 U.S.C. 154(b) by 14 days.

(21) Appl. No.: 15/510,133

(22) PCT Filed: Sep. 18, 2015

(86) PCT No.: PCT/FR2015/052504

§ 371 (c)(1),
(2) Date: Mar. 9, 2017

(87) PCT Pub. No.: WO2016/042274

PCT Pub. Date: Mar. 24, 2016

(65) Prior Publication Data

US 2017/0297657 A1 Oct. 19, 2017

(30) Foreign Application Priority Data

Sep. 19, 2014 (FR) ..... 14 58854

(51) Int. Cl.
*B63B 21/18* (2006.01)
*B63B 21/10* (2006.01)
*B63B 21/50* (2006.01)

(52) U.S. Cl.
CPC ..... *B63B 21/10* (2013.01); *B63B 21/18* (2013.01); *B63B 21/50* (2013.01)

(58) Field of Classification Search
CPC ..... B63B 21/04; B63B 21/10; B63B 21/18; B63B 21/20; B63B 2021/003; B63B 2120/20

(Continued)

(56) References Cited

U.S. PATENT DOCUMENTS 4,367,982 A * 1/1983 Hubbard ..... B63B 21/50 114/199
5,441,008 A * 8/1995 Lange ..... B63B 21/10 114/179

(Continued)

FOREIGN PATENT DOCUMENTS

FR 2 601 322 A1 1/1988
WO 2011/126171 A1 10/2011
WO 2013/088082 A2 6/2013

OTHER PUBLICATIONS

International Search Report, dated Feb. 15, 2016, from corresponding PCT application.

*Primary Examiner* — Daniel V Venne

(74) *Attorney, Agent, or Firm* — Young & Thompson

(57) ABSTRACT

Disclosed is a fairlead intended to engage with an anchor chain, for a system for anchoring a floating installation to the ground. The fairlead includes two structures assembled by pivot connection of axis, one upstream, for rigidly connecting the fairlead to the floating installation, and the other downstream, including—a unit for blocking the translational movement of the anchor chain, and—a guide, for guiding a change in direction of the anchor chain. Furthermore, the downstream structure includes two lateral plates delimiting the passage of the chain, the upstream end of each of the plates including a U-shaped bearing receiving an additional arm of the upstream structure and engaging together via a journal, the guide extending between the internal branches of the two bearings.

11 Claims, 4 Drawing Sheets

(58) Field of Classification Search
USPC ..... 114/199, 200, 230.1, 230.26, 230.27, 114/230.28, 230.29, 293
See application file for complete search history.

(56) References Cited

U.S. PATENT DOCUMENTS

| | | | | |
|---|---|---|---|---|
| 5,730,425 | A * | 3/1998 | Brooks | B63B 21/18 114/293 |
| 5,845,893 | A | 12/1998 | Groves | |
| 2005/0241558 | A1 | 11/2005 | Barlow | |
| 2012/0160146 | A1 * | 6/2012 | Miller | B63B 21/10 114/200 |
| 2016/0280333 | A1 * | 9/2016 | Trouve | B63B 21/10 |

* cited by examiner

Fig.1
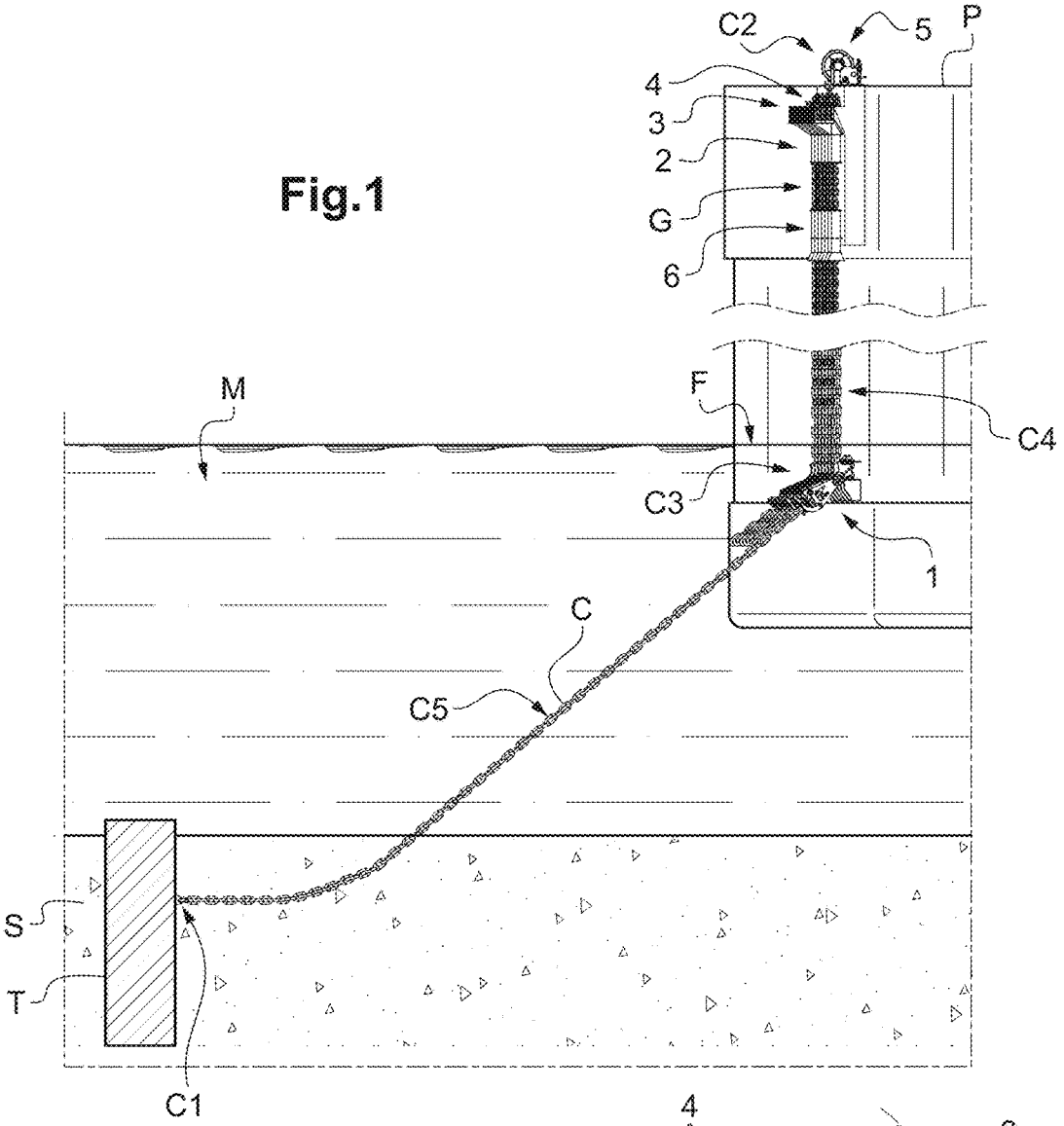
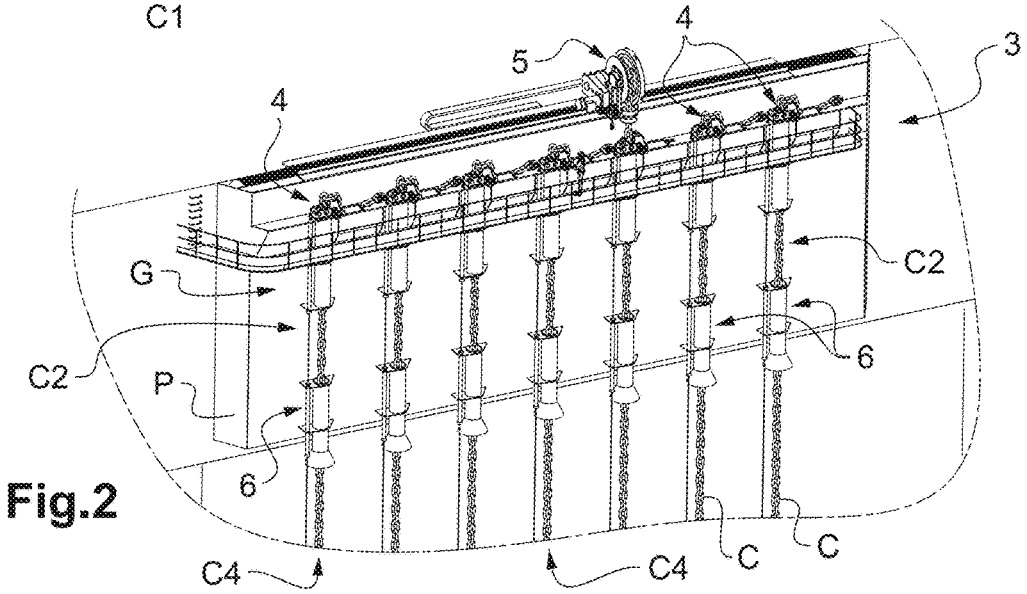
Fig.2

FAIRLEAD INTENDED TO ENGAGE WITH AN ANCHOR CHAIN, FOR A SYSTEM FOR ANCHORING A FLOATING INSTALLATION TO THE GROUND

TECHNICAL FIELD TO WHICH THE INVENTION RELATES

The present invention relates to a system for anchoring floating installations, in particular for anchoring offshore oil rigs or floating production, storage and offloading (FPSO) vessels to ground.

TECHNOLOGICAL BACKGROUND

Conventionally, offshore oil rig installations comprise floating platforms connected to a wellhead and anchored to the ground by means of anchoring chains.

These platforms, of generally square horizontal cross-section, may have sides of several tens of meters, and a weight liable to reach several tens of thousands of tons (see several hundreds of thousands of tons).

They support not only a whole means required for extraction of oil, but possibly also means for the transformation thereof; sometimes also, they include equipment intended to provide for a human presence on board.

For the anchoring thereof, several groups of chains (also called ground tackles) are generally used, each of these groups being arranged at an angle of the platform.

Each anchoring group includes several chains (for example, three to eight) arranged parallel to each other.

Each anchoring chain consists in a chain of metal links, each of which has a length of a few tenth of centimeters and is made from a wire having for example a diameter of 9 to 20 cm.

The lower end of each of these anchoring chains includes means for fixation to the ground, by means of a block buried in the sea floor. The upper end thereof extends up to a control station that is arranged on the side of the platform, above the waterline thereof, for operation by a tensioner winch.

Between the upper and lower ends, an intermediate section of these chains is associated with a device commonly called "fairlead".

These fairleads are fixed to the platform, generally under the level of the waterline.

The tension applied to each anchoring chain by the tensioner winch associated therewith is locked by a locking means, some of which may be provided within the fairlead itself, in the form, for example, of a jaw composed of two jaw members (or cheeks) articulated about axes of rotation parallel to each other.

These fairleads also provide for guiding a change of direction of the associated anchoring chain between, on the one hand, an upstream section extending vertically from the control station, and on the other hand, a downstream section extending in an inclined manner down to the block buried in the sea floor. The term "upstream" generally refers to a direction of the chain from the fairlead toward the winch, whereas "downstream" generally refers to a direction from the fairlead toward the ground.

Fairleads of this type, described for example in the documents U.S. Pat. No. 5,845,893 and WO-2013/088082, include two structures:

(i) an upstream structure for the fastening of the fairlead to the floating installation, carrying the guide means for guiding a change of direction of the anchoring chain between the upstream section and the downstream section, and (ii) a downstream structure, including the means for locking the anchoring chain in translation.

The downstream structure is assembled with the upstream structure through pivot connection means defining a horizontal axis of rotation.

This downstream structure is hence adapted to pivot about this horizontal axis of rotation, in an admissible angular sector, so as to fit to the inclination of the downstream section of the anchoring chain.

However, in practice, with the fairleads as described in these documents U.S. Pat. No. 5,845,893 and WO-2013/088082, the intermediate section of the anchoring chain is liable to undergo undesirable tensions as a function of the angular position of the downstream structure.

Indeed, this intermediate section may be subjected to a bending that is unsuited for certain inclinations of the downstream structure with respect to the guide means carried by the upstream structure.

It is also known, from the document FR-2 601 322, a fairlead for guiding an anchoring chain comprising two structures:

(i) an upstream fastening support, integral with the floating body which is desired to be anchored, and (ii) a bent downstream element including means for locking the chain, in the form of a ratchet, and guide means for guiding a change of direction of the chain.

The upstream fastening support and the downstream bent element are assembled by pivot connection means that define a horizontal axis of rotation.

However, these pivot connection means are offset under the line of passage of the chain, so as not to hamper the displacement thereof, which makes the structure bulky and harms the strength thereof.

OBJECT OF THE INVENTION

The present invention aims to address the disadvantages described above, by proposing a fairlead having a very compact and resistant structure, and that also allows reducing (or even cancelling) the phenomena of tension on the intermediate section.

For that purpose, this fairlead is of the type including:

(i) an upstream structure, for the fastening thereof to the floating installation, and (ii) a downstream structure, including locking means for locking the associated anchoring chain in translation, which downstream structure is assembled with said upstream structure through pivot connection means defining a horizontal axis of rotation, and which fairlead includes guide means, for guiding a change of direction of the anchoring chain between an upstream section and a downstream section, said guide means equipping said downstream structure;

moreover, said downstream structure comprises two lateral plates delimiting the passage of the anchoring chain and between which are arranged the locking means and the guide means;

and according to the invention, the upstream end of each of said lateral plates comprises a U-shaped bearing receiving an arm complementary of said upstream structure and cooperating together through a stud, to form the pivot connection means, each bearing comprising two opposite branches, remote from each other, said guide means extending at least between the lower branches opposite the two bearings.

In practice, such a fairlead is of reduced size and is very resistant; it further allows a guiding of the anchoring chain, without causing unsuitable bendings in its intermediate section, whatever the inclination of its downstream structure with respect to its upstream structure.

According to other advantageous characteristics, which can be taken in combination or independently of each other:

- the guide means comprise a lower surface intended to form a sliding surface for a section of the anchoring chain extending between the upstream and downstream sections; in this case, the lower surface of the guide means includes preferably (i) an upstream part, whose longitudinal section is convexly curved, and (ii) a downstream part, whose longitudinal section is rectilinear; still preferably, the upstream part of the guide means extend on either side of a radial plane that, on the one hand, passes through the horizontal axis of rotation and, on the other hand, extends perpendicular to a longitudinal axis of the downstream structure;
- the lower surface comprises (i) a longitudinal groove, intended to receive anchoring chain links whose general plane extends perpendicular to the horizontal axis of rotation of the fairlead, and (ii) two lateral bands, extending on either side of said longitudinal groove, to serve as a bearing surface for the anchoring chain links whose general plane extends parallel to said horizontal axis of rotation;
- the upstream end of the guide means is flared;
- the locking means comprise a jaw composed of two jaw members articulated about axes of rotation parallel to each other, and operation means associated with said jaw members for the operation thereof in rotation in an inverse direction between said active and inactive positions; in this case, preferably, the operation means include (i) an inert mass, called "counterweight", which is coupled in movement with said jaw members and which is operable in height between a lower position and an upper position corresponding to the active position and inactive position, respectively, of the jaw members, so as to operate and tend to hold said jaw members in said active position, and (ii) an actuator means, for the operation of said jaw members from said active position to said inactive position and for the operation of said counterweight from said lower position to said upper position.

The present invention also relates to a system for anchoring a floating installation to the ground, comprising:

- at least one fairlead as described hereinabove, and
- an anchoring chain adapted to cooperate with said fairlead, the curved upstream part of the lower surface of the guide means defining an arc of a circle whose diameter corresponds to 7 to 20 times the diameter of the wire of the links constituting said anchoring chain, preferably of the order of 15 to 18 times.

DETAILED DESCRIPTION OF AN EXEMPLARY EMBODIMENT

The invention will be further illustrated, without being limited in anyway, by the following description of a particular embodiment shown in the appended drawings, in which:

FIG. 1 partially shows a floating platform, equipped with an anchoring system according to the invention shown in a slight perspective view;

FIG. 2 is an enlarged view of the upper part of the anchoring system of FIG. 1, according to a perspective allowing the observation of juxtaposed anchoring chains;

As schematically shown in FIG. 1, the fairleads 1 according to the invention are intended to be a part of a system 2 for anchoring a floating platform P to the ground (this platform P is herein shown only partially).

This platform P floats on the mass of water M, above the ground S of the sea floor, by defining a waterline F.

The anchoring system 2 is consisted of several anchoring groups G, for example each arranged at one of the angles of the platform P (in FIG. 1, only one of these anchoring groups G is shown).

As illustrated in FIG. 2, each anchoring group G comprises a plurality of anchoring chains C (herein seven anchoring chains C), which are juxtaposed and arranged parallel or substantially parallel to each other.

Figure 5:
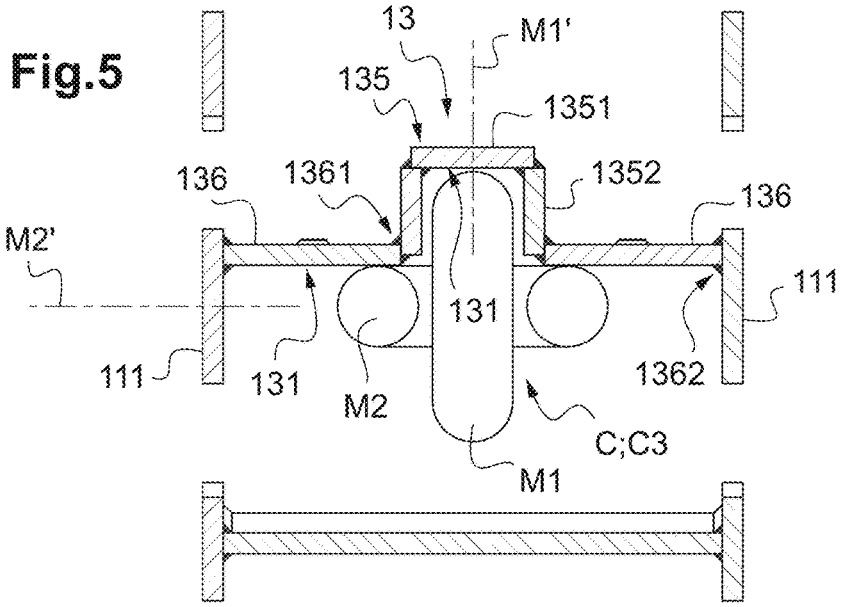
FIG. 5 is a sectional view of the downstream structure of the fairlead, according to a transversal sectional plane passing through the guide means.

Each anchoring chain C is formed of a plurality of metal links M1, M2, interleaved two by two (visible in particular in FIG. 5).

These links M1, M2 each define a general plane, respectively, M1', M2'.

The general planes M1', M2' of two successive links M1, M2 extend perpendicular to each other.

These links M1, M2 are made of steel; their length may be of the order of 50 to 120 cm, and their width may be of the order of 30 to 80 cm. They are made of a wire whose diameter is for example comprised between 9 and 20 cm.

The downstream lower end C1 of the anchoring chains C is fixed by any suitable means to a block T put on the ground S of the sea floor, or preferably buried into this ground S (in FIG. 1, only the lower end C1 of one of the chains C is shown).

The upstream upper end C2 of the different chains C extends up to a control station 3 equipping the platform P, above the waterline F, and herein at the upper part of the platform P (FIGS. 1 and 2).

Within this control station 3 (shown in particular in FIG. 2), there are in particular:

- stopper means 4, adapted to ensure a locking in translation of each of the chains C, and
- tensioner means 5, herein comprising a single tensioner winch mounted mobile in translation above the stopper means 4 for the tensioning of each of the chains C constitutive of the anchoring group G.

The stopper means 4 that cooperate with each chain C consist in mechanisms of the jaw type including two jaw members articulated about horizontal axes.

These jaw members are operable in reverse direction relative to each other (for example, by means of an operating wheel) between—an active position, for the locking in translation of the associated anchoring chain C in an upstream-to-downstream direction, and—an inactive position, in which they are spaced apart from each other so as to allow the translation of the chain C.

The tensioner winch 5 consists for example in an electrical winch, adapted to operate in both directions the anchoring chain C that is associated therewith.

This tensioner winch 5 is herein mounted on a rolling frame guided by a rail structure, which is arranged along a rolling path parallel to the stopper means 4.

As an alternative, not shown, the upper end C2 of each of the anchoring chains C is associated with its own fixed tensioner winch.

Each anchoring chain C has also an intermediate section C3, extending between its lower end C1 and its upper end C2.

This intermediate section C3 cooperates with one of the fairleads 1, herein fixed to the platform P and under the level of its waterline F.

This fairlead 1 allows offsetting, under the waterline F, the point from which the associated anchoring chain C moves apart from the platform P (FIG. 1).

Each fairlead 1 hence ensures the guiding of a change of direction of this intermediate section C3 of the anchoring chain C, between:

- a vertical upstream section C4 (or vertical upstream strand), extending from the control station 3 (more precisely from the associated stopper means 4) and down to the fairlead 1, and
- an inclined downward section C5 (or inclined downstream strand), extending along a descending slop from this fairlead 1 down to the block T of anchoring to the ground S.

As illustrated in FIGS. 1 and 2, a trough section 6 participates to the guiding and the holding of the vertical section C4 of each anchoring chain C.

The structure and the operation of the fairlead 1 according to the invention are described hereinafter in relation with FIGS. 3 to 9.

Figure 3:
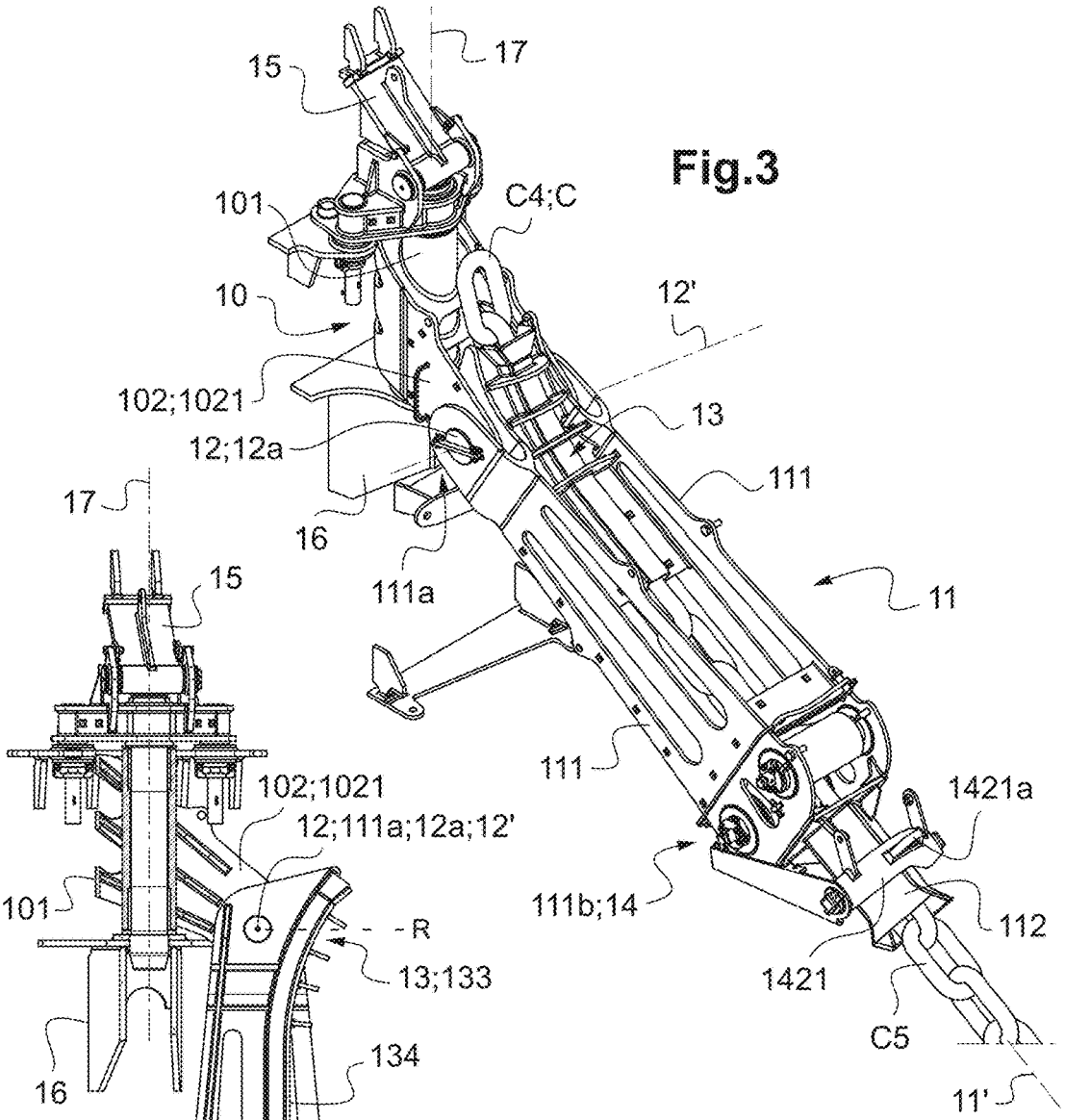
FIG. 3 shows, in a perspective and enlarged view, one of the fairleads equipping the anchoring system according to FIG. 1.
Figure 4:
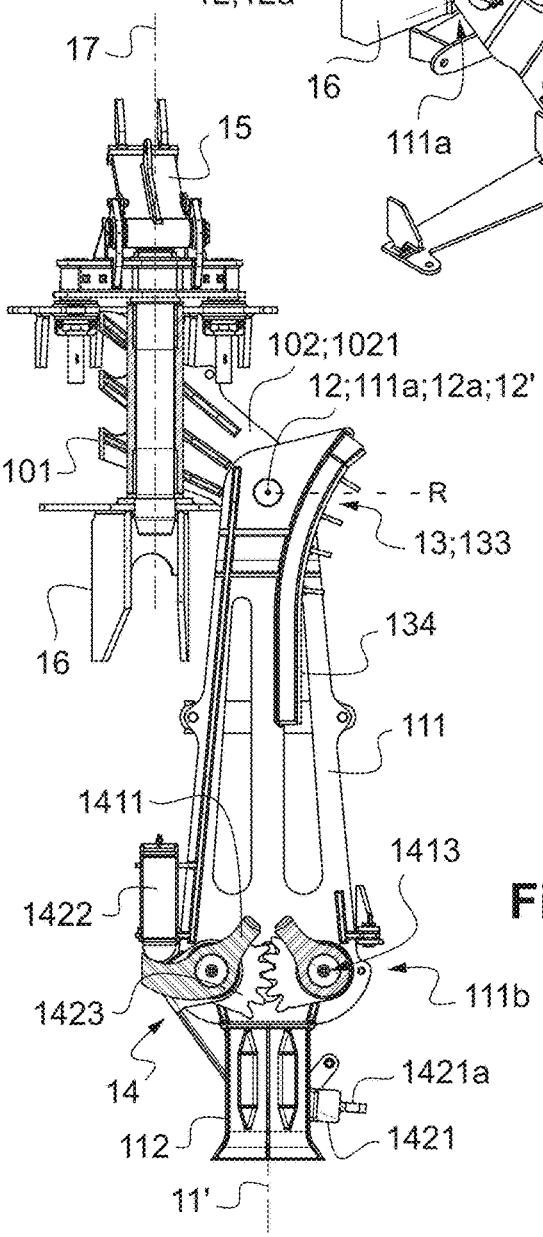
FIG. 4 is a sectional view of the fairlead of FIG. 3, according to a vertical longitudinal sectional view.

As illustrated in FIGS. 3 and 4, the fairlead 1 includes two structures:

(a) an upstream structure 10, for the fastening of this fairlead 1 to the floating installation P, and (b) a downstream structure 11, free in rotation about a horizontal axis of rotation 12', which includes:

(b1) guide means 13, for guiding a change of direction of the anchoring chain C between its upstream section C4 and its downstream section C5, and (b2) locking means 14 for the locking in translation of the anchoring chain C.

Such a fairlead structure 1, and in particular the presence of guide means 13 on the downstream structure 11, allows reducing (or even cancelling) the possible phenomena of tension generated on the intermediate section C3 of the anchoring chain C, whatever the inclination of the downstream structure 11 about its axis of rotation 12'.

Herein, the upstream structure 10 of the fairlead 1 is assembled with a support part 15 that is removably fastened to a receiving part 16 fixed to the floating platform P, for example by welding and/or added parts (screwing, riveting, etc.).

The upstream structure 10 is fastened to the support part 15 so as to provide it a rotational degree of freedom about an axis 17 extending vertically, or at least approximately vertically (FIGS. 3 and 4).

For that purpose, the support part 15 includes a cylindrical journal bearing (not visible on the figures), on which is fitted and guided into rotation a cylindrical rear part 101 (forming a stud) of the upstream structure 10.

This upstream structure 10 also includes a carrier part 102 on which is added the downstream structure 11.

This carrier part 102 herein comprises two lateral arms 1021 (each in the form of a plate), which extend parallel and opposite each other, each in a vertical plane.

Each lateral arm 1021, cantilevered from the cylindrical rear part 101, includes two ends:

- a rear end fastened to the cylindrical rear part 101, and
- a front end fastened to the downstream structure 11, through pivot connection means 12, so as to form the horizontal axis of rotation 12'.

These two lateral arms 1021 have a suitable spacing to define, between them, a passage for the anchoring chain C.

For its part, the downstream structure 11 comprises a support part 111 that carries the guide means 13 and the locking means 14.

The support part 111 is herein consisted by two lateral metal plates (denoted by the same reference 111), which are arranged parallel and remote from each other, on either side of a longitudinal axis 11' of the downstream structure 11

The lateral plates 111, arranged in vertical planes, define the passage of the anchoring chain C.

Each lateral plate 111 includes two ends:

- an upstream end 111*a*, pivotally mounted on one of the lateral arms 1021 of the upstream structure 10, and that about the horizontal axis of rotation 12', and
- a downstream end 111*b* carrying, with the downstream end 111*b* of the opposite lateral plate 111, a square-section tubular member 112 for the guiding of the downstream section C5 of the anchoring chain C.

These upstream 111*a* and downstream 111*b* ends also form the upstream and downstream ends, respectively, of the downstream structure 11 (respectively denoted by the same references).

Figure 6:
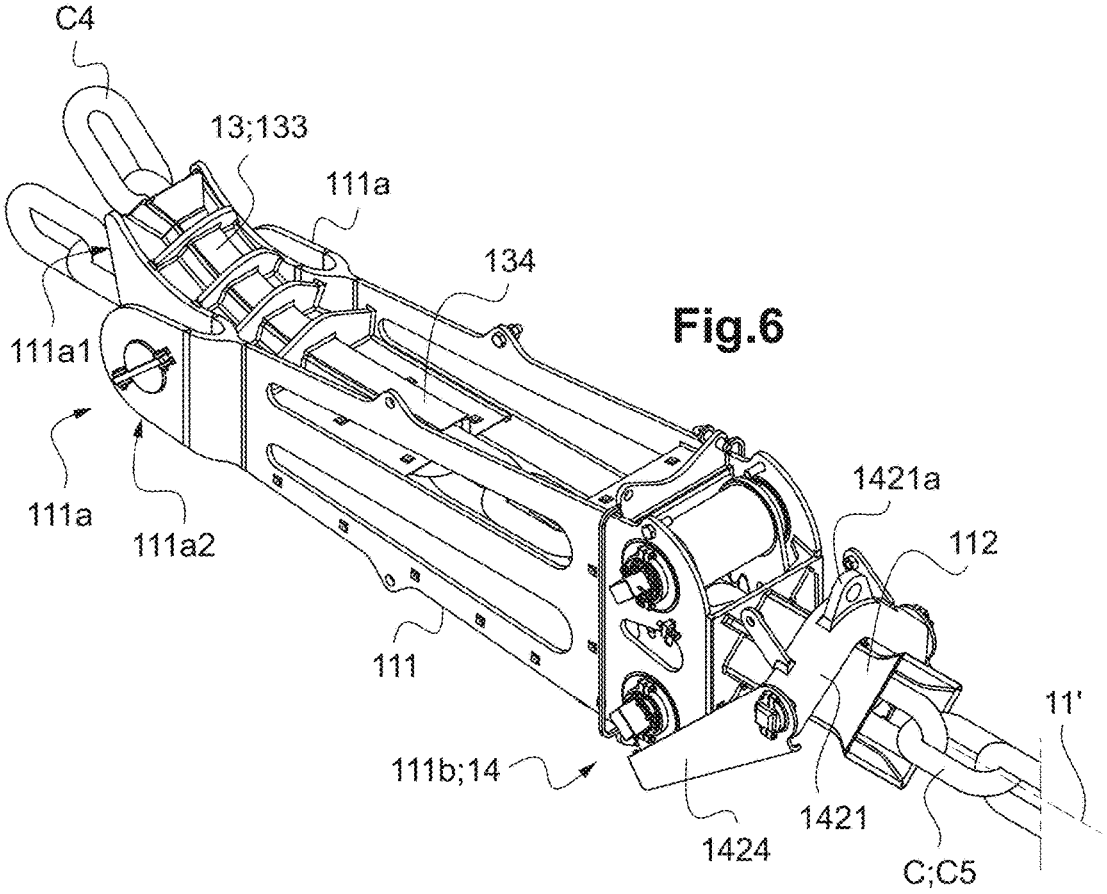
FIG. 6 shows, in a perspective view, and in isolation, the downstream structure of the fairlead illustrated in FIGS. 3 to 5.
Figure 7:
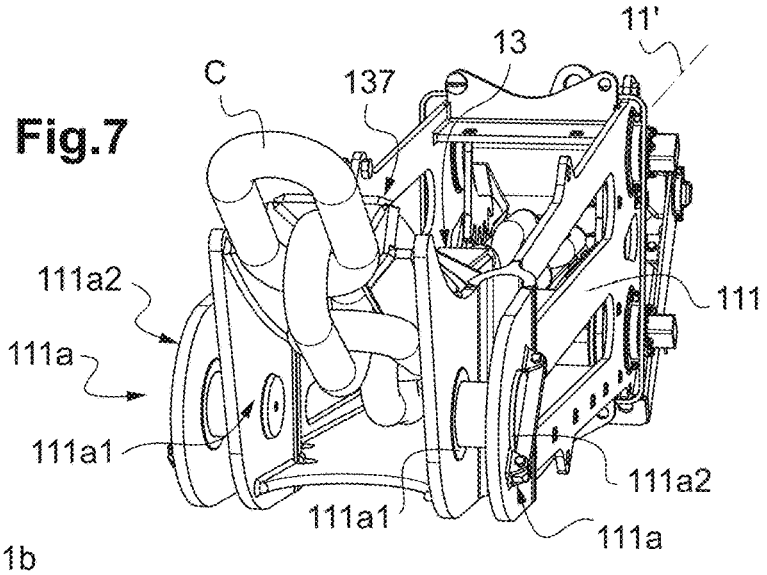
FIG. 7 shows this same downstream structure of the fairlead, in isolation and on the side of its end intended to cooperate with the upstream structure.

Herein, as shown in particular in FIGS. 6 and 7, the upstream end 111*a* of each of the lateral plates 111 consists in a U-shaped bearing.

Each bearing 111*a* comprises two opposite branches, remote from each other:

- an internal branch 111*a*1, extending opposite the other lateral plate 111 of the downstream structure 11, and
- an external branch 111*a*2, extending remote from the other lateral plate 111 of the downstream structure 11.

Each upstream end 111*a* hence receives one of the two lateral arms 1021 of the upstream structure 10, between its two branches 111*a*1, 111*a*2, and cooperates together through a stud 12*a*.

The pivot connection means 12 of the downstream structure 11 hence comprise two studs 12*a*, arranged remote from each other and coaxially to each other to define the horizontal axis of rotation 12'.

Such a structure is in particular used to define the horizontal axis of rotation 12', while keeping a passage for the anchoring chain C within the downstream structure 11.

In this fairlead 1 according to the invention, the guide means 13 and the locking means 14 are arranged between the lateral plates 111 of the downstream structure 11:

- the guide means 13 are arranged between the upstream ends 111*a* opposite the lateral plates 111, and the locking means 14 are arranged between the downstream ends 111*b* opposite the lateral plates 111.

The guide means 13 are herein formed by an elongated metal part that is fastened between the two lateral plates 111 of the downstream structure 11, and they extend over a part of the length of this downstream structure 11.

The lower surface 131 of this elongated metal part 13 constitutes a sliding surface for the intermediate section C3 of the guiding chain C.

Herein, this lower surface 131 of the guide means 13 includes:

an upstream part 133 whose longitudinal section is convexly bent, on the side of the chain C, and a downstream part 134 whose longitudinal section is rectilinear.

By "longitudinal section", it is understood in particular a sectional plane extending parallel to the lateral plates 111 of the downstream structure 11 or perpendicular to its horizontal axis of rotation 12'.

In particular, the upstream part 133 of the guide means 13 extends opposite and remote from the horizontal axis of rotation 12'.

This upstream part 133 of the guide means 13 hence extends on either side of a radial plane R that, on the one hand, passes through the horizontal axis of rotation 12', and on the other hand, extends perpendicular to the longitudinal axis 11' of the downstream structure 11 (FIG. 4).

Herein, the guide means 13, and in particular the curved upstream part 133, extend between the internal branches 111*a*1 opposite the two upstream ends 111*a* of the lateral plates 111.

This upstream part 133 herein defines an arc of a circle, extending over an angular sector of the order of 30° to 50°.

The diameter of this upstream part 133 advantageously corresponds to 7 to 20 times the diameter of the wire of the links constituting the anchoring chain C, preferably of the order of 15 to 18 times.

This structural characteristic aims to provide the intermediate section C3 of the anchoring chain C with an optimal curve.

For example, for a wire having links of 157 mm, the diameter of the upstream part 133 is advantageously of 2680 mm.

The downstream part 134 itself extends parallel to the longitudinal axis 11' of the downstream structure 11.

This downstream part 134 extends over only a part of the length of the downstream structure 11, and hence ends up remote from the locking means 14.

As shown in details in FIG. 5, the lower surface 131 of the guide means 13 comprises, over its whole length:

a longitudinal groove 135, intended to receive links M1 of the anchoring chain C whose general plane M1' extends perpendicular to the horizontal axis of rotation 12', and two lateral bands 136, extending on either side of said longitudinal groove 135, to serve as a bearing surface for the links M2 of the anchoring chain C whose general plane M2' extending parallel to the horizontal axis of rotation 12'.

The longitudinal groove 135 herein consists in a part having a horizontal cross-section in a reverse U-shape, which is composed of a bottom wall 1351 extended by two lateral walls 1352 extending remote from and opposite each other.

The two lateral bands 136 themselves extend opposite each other and perpendicularly to the lateral walls 1352 of the longitudinal groove 135 and with respect to the lateral plates 111.

These lateral bands 136 each include two edges:

an internal edge 1361 that is connected to an internal edge of one of the lateral walls 1352 of the longitudinal groove 135, and an external edge 1362 that is connected to one of the lateral plates 111 of the downstream structure 11.

As illustrated in particular in FIG. 7, the upstream end 137 of the guide means 13 is herein flared, so as to facilitate the passage of the chain C at the guide means 13.

Generally, the guide means 13 are dimensioned as a function of the size of the links M1, M2 constituting the anchoring chain C.

In particular, the distance separating the two lateral plates 111 opposite the downstream structure 11 is identical to (within the clearance), or higher than, the width of the links M1, M2 of the chain C.

The depth of the bottom wall 1351 of the guide means 13 is slightly higher than half the width of the links M1, M2 of the chain C.

The width of this bottom wall 1351 is, on the one hand, identical to (within the clearance), or higher than, the diameter of the wire of the links of the chain C, and on the other hand, lower than the width of said links.

But, in practice, these guide means 13 are adapted to receive several sizes of chain links, or even a cable useful during the installation of the anchoring chain C.

For example, the depth of the bottom wall 1351 of the guide means 13 is of 200 mm; the width of this bottom wall 1351 is of 170 mm.

The locking means 14 themselves comprise a jaw 141 (visible in particular in FIGS. 8 and 9) and an operation means 142 associated therewith.

The jaw 141, implanted between the two lateral plates 111 of the downstream structure 11 (at their opposite downstream ends 111*b*), are composed of two jaw members 1411, a lower one 1411*a* and an upper one 1411*b*.

These jaw members 1411 each have two ends:

a downstream end 1412, articulated about an axis of rotation 1413 (respectively 1413*a* and 1413*b*), and an upstream end 1414, intended to cooperate with the links M1, M2 of the anchoring chain C (FIG. 8), in particular with the downstream end of the links M1 extending in a vertical plane.

The axes of rotation 1413 of these two jaw members 1411 extend horizontally, parallel to each other, and also parallel to the horizontal axis of rotation 12' of the downstream structure 11.

The operation means 142 themselves include:

an inert mass 1421, called "counterweight", which is mobile between a lower position (FIG. 8) and an upper position (FIG. 9) and carried by two arms 1424, and which is coupled in movement with the jaw members 1411 for their movement in a direction of rotation, an actuator means 1422, for operation of the jaw members 1411 in a reverse direction of rotation, including a cylinder 1422*a* and a mobile rod 1422*b*, and gears 1423, to ensure a synchronous rotation of the two jaw members 1411, and in a reverse direction of rotation relative to each other.

Figure 8:
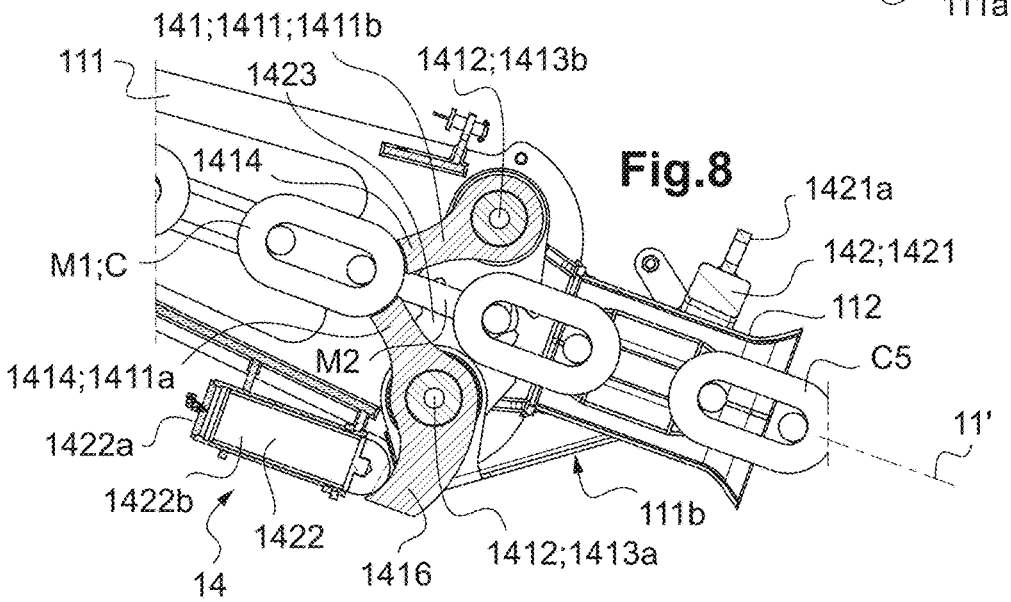
FIGS. 8 and 9 are partial views of the downstream structure of the fairlead, according to a longitudinal sectional view, which show the jaw members of the jaw, in the active position and the inactive position, respectively.

The counterweight 1421 has generally a downwardly open V- or U-shape, intended in lower position to straddle the tubular member 112 of the downstream structure 11 (FIG. 8—the horizontal link M2 downstream of the vertical link M1 in rest blocks the closing of the jaw members 1411 and hence the descent of the counterweight 1421 just above and with no contact with the tubular member 112).

This counterweight 1421 has for example a mass comprised between 100 kg and 2000 kg.

This counterweight 1421 is carried by two arms 1424 (FIG. 6) connected with the lower jaw member 1411*a* of the jaw 141.

Each arm 1424 includes, on the one hand, a first end fastened to a lateral end of the counterweight 1421, and on the other hand, a second end fastened to the lower jaw member 1411*a*.

These arms 1424 are hence coupled on either side of the lower jaw member 1411*a*, ensuring the operation of these arms 1424 and of the associated counterweight 1421 about the axis of rotation 1413*a* of said associated lower jaw member 1411*a*.

The actuator means 1422 herein consists in a linear actuator carried by the downstream structure 11, and in particular by the lower face thereof.

The linear actuator 1422 herein consists in a pneumatic cylinder, associated with an air supply and with an air distributor (not shown) located at the control station 3.

More precisely, this linear actuator 1422 is a single-effect pneumatic cylinder, cooperating with a lower extension 1416 of the lower jaw member 1411*a* of the jaw 141.

This linear actuator 1422 is herein fixed with no degree of freedom and extends parallel, or at least approximation parallel, to the longitudinal axis 11' of the downstream structure 11.

This linear actuator 1422 includes a cylinder 1422*a* and a mobile rod 1422*b*.

The rod 1422*b* is extendable; its free end has a general form of spherical cap to cooperate with a rear face of the lower extension 1416 of the lower jaw member 1411*a*.

The gears 1423 herein consist in two plates that are each rotationally fastened to one of the jaw members 211.

These plates 1423 extend in a same plane that is perpendicular to the axis of rotation 1413 of these jaw members 1411.

These plates 1423 meshes with each other through a rack extending over an arc of a circle, hence forming a portion of a wheel or a pinion (visible in FIG. 4).

The working of this fairlead 1, as well as the operation of these jaw members 1411 between the active and inactive positions, is described hereinabove in relation with FIGS. 8 and 9.

In particular, for the locking in translation of the anchoring chain C, the rod 1422*b* of the linear actuator 1422 is retracted into the cylinder 1422*a* thereof (FIG. 8).

The counterweight 1421 is in lower position, ensuring the holding of the jaw members 1411 in the active position due to the force exerted.

The upstream ends 1414 of these jaw members 1411, moved closer to each other, then come into abutment on one of the links of this anchoring chain C (i.e. a link M1 herein extending vertically, and parallel to the plates 111); these jaw members 1411 hence converge from their downstream ends 1412 to their upstream ends 1414.

This active position is held thanks to the counterweight 1421, in lower position, coupled to the lower jaw member 1411*a*.

The counterweight 1421 is herein directly overlying the downstream duct 112, and hence extends up to above the downstream section C5 of the anchoring chain C.

This counterweight 1421 hence exerts a moment of force to the lower jaw member 1411*a* through its arms 1424, in a first direction of rotation (herein clockwise in the figures); the gears 1423 transmit a moment of force to the upper jaw member 1411*b*, in a second direction of rotation (anticlockwise).

The anchoring chain C is hence suitably locked in translation by the locking means 14, in the upstream-to-downstream direction.

This anchoring chain C is in addition in rest against the lower surface 131 of the guide means 13 of the downstream structure 11, as illustrated in FIG. 5.

This arrangement of the guide means 13 on the downstream structure 11 allows limiting, or even cancelling, unsuitable bendings of the intermediate section, as a function of the inclination of the downstream section 11, which would then be liable to generate undesirable tensions on the latter.

Figure 9:
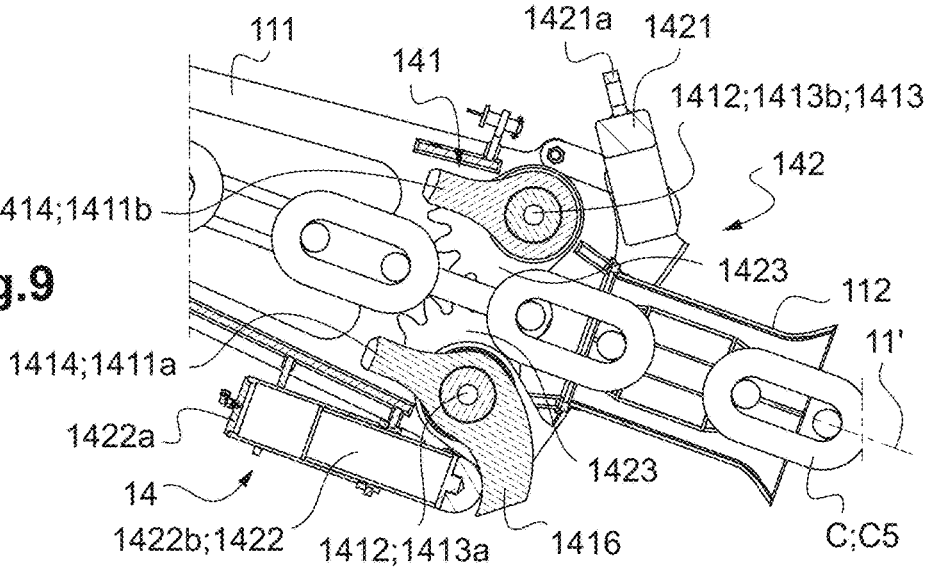

For the operation of the anchoring chain C, in particular in the upstream-to-downstream direction, the operation means are piloted so as to cause the extraction of the rod 1422*b* of the linear actuator 1422, with respect to the cylinder 1422*a* thereof (FIG. 9).

This operation then causes the displacement of the end of the rod 1422*b* that comes in rest on the lower extension 1416 of the lower jaw member 1411*a*, then generating the pivoting of this jaw member 1411*a* about its axis of rotation 1413*a* in the anticlockwise direction.

This movement is transmitted to the upper jaw member 1411*b* through gears 1423, generating the pivoting thereof in a reverse direction (clockwise direction in FIG. 9).

This movement of rotation in the reverse direction of the two jaw members 1411 allows the operation thereof from the active position to the inactive position.

During this operation, the counterweight 1421 is itself operated from its lower position (near the downstream tubular section 112—FIG. 8) to an upper position (remote from this same tubular section 112—FIG. 9).

The counterweight 1421 operated in this upper position allows the accumulation of a mechanical potential energy, in particular a weight potential energy.

It will be noted that the counterweight 1421 in the lower position (FIG. 8) and in the upper position (FIG. 9) is offset downstream with respect to its axis of rotation 1413*a* (i.e. also offset downstream with respect to the axis of rotation of its associated arms 1424).

Its centre of gravity hence always remains on the downstream side with respect to the vertical plane passing through this axis of rotation 1413*a*, hence favouring the pivoting thereof in the clockwise direction according to FIGS. 8 and 9.

The anchoring chain C may then be operated in translation within the fairlead 1, in both directions.

For the return of the jaw members 1411 to the active position, it is sufficient to eliminate the air pressure in the actuator 1422.

The counterweight 1421 then causes the retraction of the rod 1422*b* in its cylinder 1422*a* and the pivoting of the associated jaw members 1411 in the active position (FIG. 8).

This embodiment with a linear actuator 1422 has for interest to be simple and reliable, with the use of a single-effect actuator (hence with a single sealing gasket).

The presence of such a counterweight 1421 for the operation and the holding of the jaw members 1411 in the active position is also useful during the tensioning of the anchoring chain C, or for tightening a slightly slack anchoring chain C.

Indeed, it is then sufficient to exert a traction in the downstream-to-upstream direction on the anchoring chain C; the jaw members 1411 ensuring a ratchet phenomenon under the action of the associated counterweight 1421 (the jaw members 1411 are spaced apart during the passage of each vertical link M1 of the chain C).

In this embodiment, the counterweight 1421 is moreover equipped with a hooking plate 1421*a* (FIG. 3) on which may be fixed a hook so as to be able to exert an upward traction on this counterweight 1421 and to hence bring it from its lower position to its upper position.

This plate 1421*a* is useful in particular as a redundant security means, to allow the opening of the jaw 141 and to release the chain C within the fairlead 1, in case of breakdown of the pneumatic system, for example.

The fairlead according to the invention hence offers a simple and efficient solution to reduce, or even cancel, the tensions during the angular variation of the downstream structure 11 about its horizontal axis of rotation 12'.

The fairlead 1 according to the invention has for interest an efficient guiding at the level of the intermediate section of the anchoring chain, without exerting a possible additional tension generated by the variations of inclination of the downstream structure.

The invention claimed is:

1. A fairlead for guiding an anchoring chain and operable with a system for anchoring a floating installation to ground, the fairlead comprising:

an upstream structure that fastens to said floating installation; and a downstream structure, including locking means for locking said anchoring chain in translation, said downstream structure assembled with said upstream structure by way of a pivot connection that defines a horizontal axis of rotation; and guide means, for guiding a change of direction of the anchoring chain between an upstream section of the chain that is received from the floating installation and a downstream section of the chain that exits the fairlead in a direction toward the ground, said guide means being located on said downstream structure, wherein said downstream structure comprises two lateral plates delimiting a passage for the anchoring chain, wherein the locking means and the guide means are located between the two lateral plates, wherein an upstream end of each of said lateral plates comprises a U-shaped bearing that receives a complementary arm that is complementary of the upstream structure, the complementary arms cooperating with the lateral plates via a stud to form the pivot connection, each U-shaped bearing comprising two opposing branches that are positioned remotely from each other, and wherein said guide means extend at least between lower branches (111*a*1) of said two opposing branches opposite the U-shaped bearings of the lateral plates.

2. The fairlead according to claim 1, wherein the guide means comprise a lower surface that forms a sliding surface for an intermediate section of the anchoring chain between the upstream and downstream sections of the anchoring chain.

3. The fairlead according to claim 2, wherein the lower surface of the guide means includes:

an upstream part with a longitudinal section that is convexly curved, and a downstream part with a longitudinal section that is rectilinear.

4. The fairlead according to claim 3, wherein the upstream part of the guide means extends on either of a first side or an opposing second side of a radial plane (R) that passes through the horizontal axis of rotation, and extends perpendicular to a longitudinal axis of the downstream structure.

5. The fairlead according to claim 2, wherein the lower surface comprises:

a longitudinal groove that receives first links (M1) of the anchoring chain, a first general plane (M1') of said first links (M1) extending perpendicularly to the horizontal axis of rotation, and two lateral bands, extending on either side of said longitudinal groove, configured as a bearing surface for second links of the anchoring chain, a second general plane (M2') of said second links (M2) extending parallel to said horizontal axis of rotation.

6. The fairlead according to claim 1, wherein the locking means comprise a jaw composed of two clamping jaws articulated about respective axes of rotation parallel to each other, said clamping jaws being associated with operation means for operating said clamping jaws in rotation in a reverse direction between active and inactive positions.

7. The fairlead according to claim 6, wherein the operation means include:

a counterweight coupled in movement with said clamping jaws, said counterweight operable in height between a lower position and an upper position corresponding respectively to said active position and said inactive position of said clamping jaws, configured so as to urge said clamping jaws toward said active position, and an actuator means for operatively actuating said clamping jaws from said active position to said inactive position, and for operatively actuating said counterweight from said lower position to said upper position.

8. A system for anchoring a floating installation (P) to ground, comprising:

at least one fairlead according to claim 3; and an anchoring chain adapted to cooperate with said fairlead, wherein the upstream part of the lower surface of the guide means is curved such to define an arc of a circle with a diameter that is 7 to 20 times a diameter of a wire of the links (M1, M2) constituting said anchoring chain.

9. The fairlead according to claim 2, wherein the lower surface comprises:

a longitudinal groove that receives first links (M1) of the anchoring chain, a first general plane (M1') of said first links (M1) extending perpendicularly to the horizontal axis of rotation, and two lateral bands, extending on either side of said longitudinal groove, configured as a bearing surface for second links of the anchoring chain, a second general plane (M2') of said second links (M2) extending parallel to said horizontal axis of rotation.

10. The fairlead according to claim 2, wherein the lower surface comprises:

a longitudinal groove that receives first links (M1) of the anchoring chain, a first general plane (M1') of said first links (M1) extending perpendicularly to the horizontal axis of rotation, and two lateral bands, extending on either side of said longitudinal groove, configured as a bearing surface for second links of the anchoring chain, a second general plane (M2') of said second links (M2) extending parallel to said horizontal axis of rotation.

11. The system according to claim 8, wherein the upstream part of the lower surface of the guide means is curved such to define an arc of a circle with a diameter that is 15 to 18 times the diameter of the wire of the links constituting said anchoring chain.

* * * * *